United States Patent [19]

Battaglia

[11] 3,984,139

[45] Oct. 5, 1976

[54] EXCREMENT SCOOP DEVICE

[75] Inventor: Eugene Paul Battaglia, Bronx, N.Y.

[73] Assignee: Charles J. Spiegel, Jr., Bronx, N.Y.

[22] Filed: Aug. 28, 1975

[21] Appl. No.: 608,410

[52] U.S. Cl. ..... 294/19 R; 294/1 R

[51] Int. Cl.[2] ..... A01K 29/00; A47F 13/08

[58] Field of Search ..... 294/1 R, 19 R, 19 A, 294/55, 100; 15/104.8, 257.1, 257.4, 257.6, 257.7; 56/328 R, 332; 150/3, 11; 119/1, 153; 248/95, 99

[56] References Cited

UNITED STATES PATENTS

| | | | |
|---|---|---|---|
| 3,052,214 | 9/1962 | Johnson | 294/1 R X |
| 3,446,525 | 5/1969 | Jones | 294/19 R |
| 3,606,436 | 9/1971 | Lynch | 294/19 R |
| 3,716,263 | 2/1973 | Gatti | 294/19 R |
| 3,777,708 | 12/1973 | Vogt | 294/19 R X |
| 3,802,728 | 4/1974 | Giacopelli | 294/19 R |
| 3,817,448 | 6/1974 | Schneider | 248/99 X |

FOREIGN PATENTS OR APPLICATIONS

| | | | |
|---|---|---|---|
| 1,136,657 | 5/1957 | France | 56/332 |

*Primary Examiner*—Johnny D. Cherry
*Attorney, Agent, or Firm*—Bauer, Amer & King

[57] ABSTRACT

A device for the sanitary removal of the excrement of a dog or other pet from a pavement or similar surface, in the use of which a plastic or similar removal bag is supported upside-down on the device so that the bag opening can be advantageously placed in covering relation over the excrement and said opening is then drawn closed beneath the excrement, thereby transferring the excrement to a position within the bag and thus permitting its sanitary disposal.

10 Claims, 9 Drawing Figures

FIG.3

EXCREMENT SCOOP DEVICE

The present invention relates generally to an improved convenience device for dog and other pet owners, and more particularly to a device which facilitates the sanitary removal of dog excrement from a pavement or similar surface.

Devices for the sanitary pick-up or scooping removal of pet excrement are already well known, since population density and the maintaining of proper sanitary conditions require the use of such devices. While generally effective, these devices are not totally satisfactory from the viewpoint of convenience of use. They require cleaning, from time to time, close proximity of the user to the excrement, and have other such shortcomings.

Generally, it is an object of the present invention to provide an improved dog excrement removal device overcoming the foregoing and other shortcomings of the prior art. Specifically, it is an object to provide a pet excrement device which during removal service effectively utilizes a disposable removal bag, of which there is optimum nominal contact required, and which accordingly readily lends itself to a sanitary, effective and convenient disposal procedure.

A dog excrement scoop device demonstrating objects and advantages of the present invention contemplates the use of a plastic bag for receiving the excrement preparatory to its removal, and includes a bag-holding member of a selected shape bounding an opening about which said bag is supported in inverted relation with an opening communicating into said bag being formed by said shape. The device further includes a handle and means for connecting the bag-holding member and inverted bag in depending relation from the handle so as to facilitate the placement of the opening of the inverted bag in surrounding relation over the excrement. After this is accomplished, normally spread apart closure means on the bag-supporting shape are actuated through closing movement into the opening of the shape, whereby the bag opening is adapted to be closed about the excrement and thereafter inverting the bag provides a disposal enclosure for same.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figures 1, 2A, 2B, 2C, 3, 4:
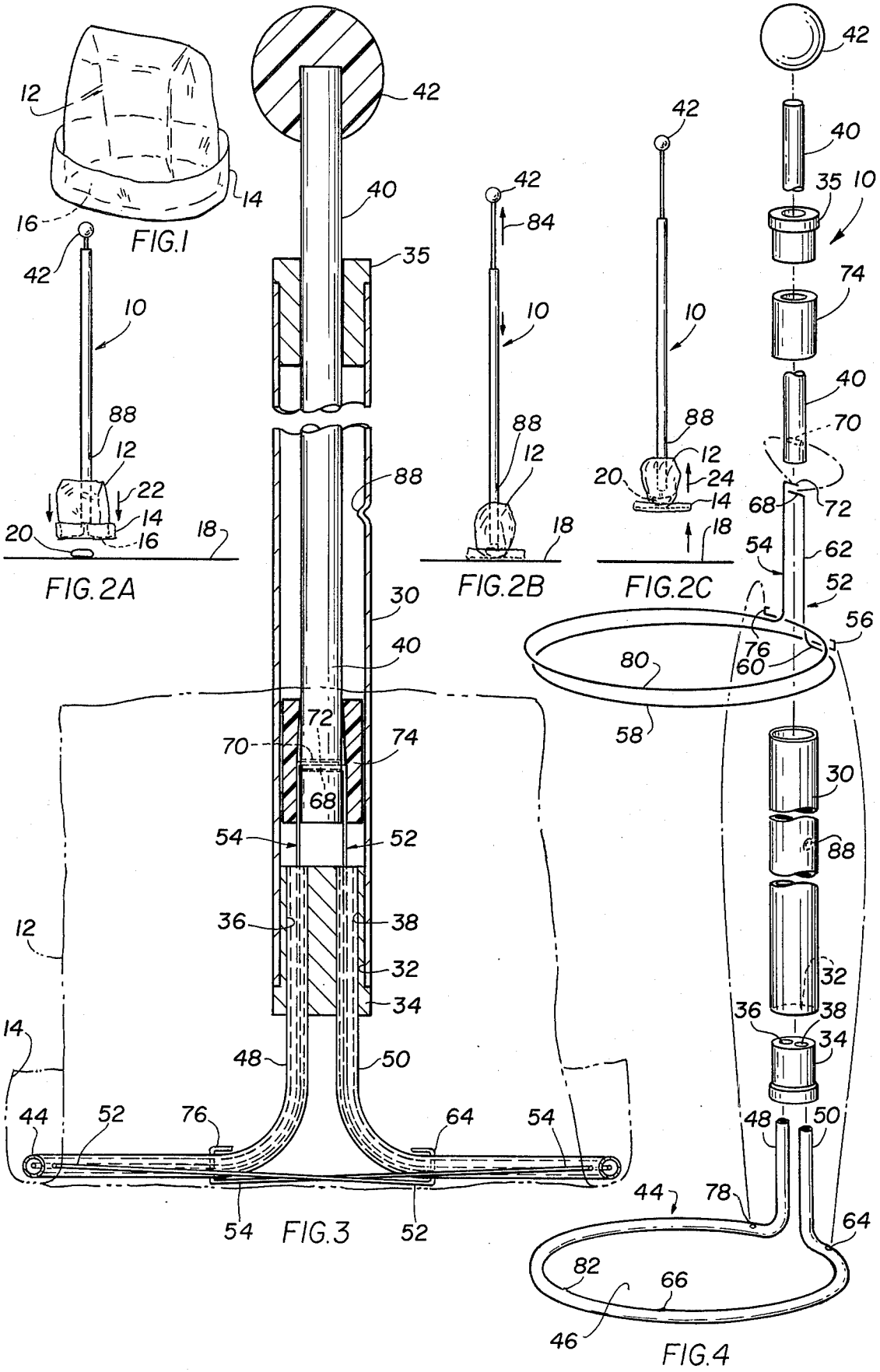
FIG. 1 is a perspective view of a removal bag used with the scoop device hereof.
FIGS. 2A, 2B and 2C are front elevational views illustrating, in progressive fashion, the contemplated mode of using the device hereof.
FIG. 3 is a front elevational view, on an enlarged scale, in section taken on line 3—3 of FIG. 5 illustrating further structural details.
FIG. 4 is an exploded perspective view of the device illustrating the separate components thereof.
Figure 5:
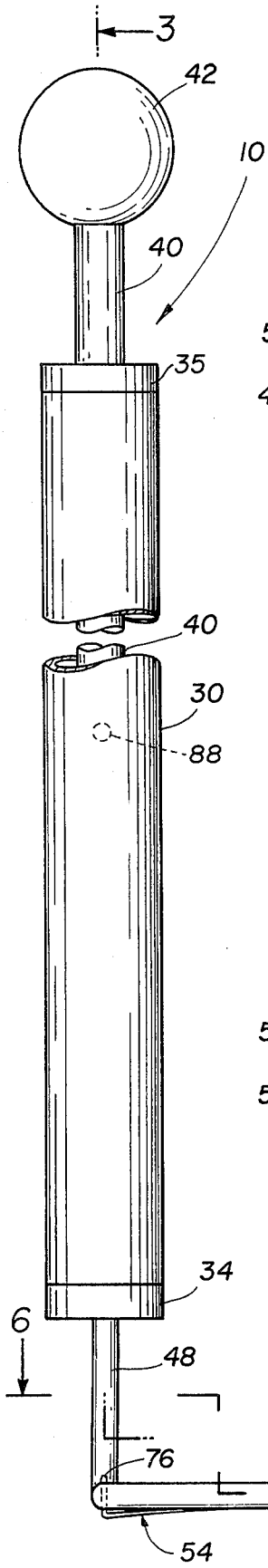
FIG. 5 is a side elevational view of the device, on the same scale as FIG. 3, illustrating further structural details thereof.
Figure 6:
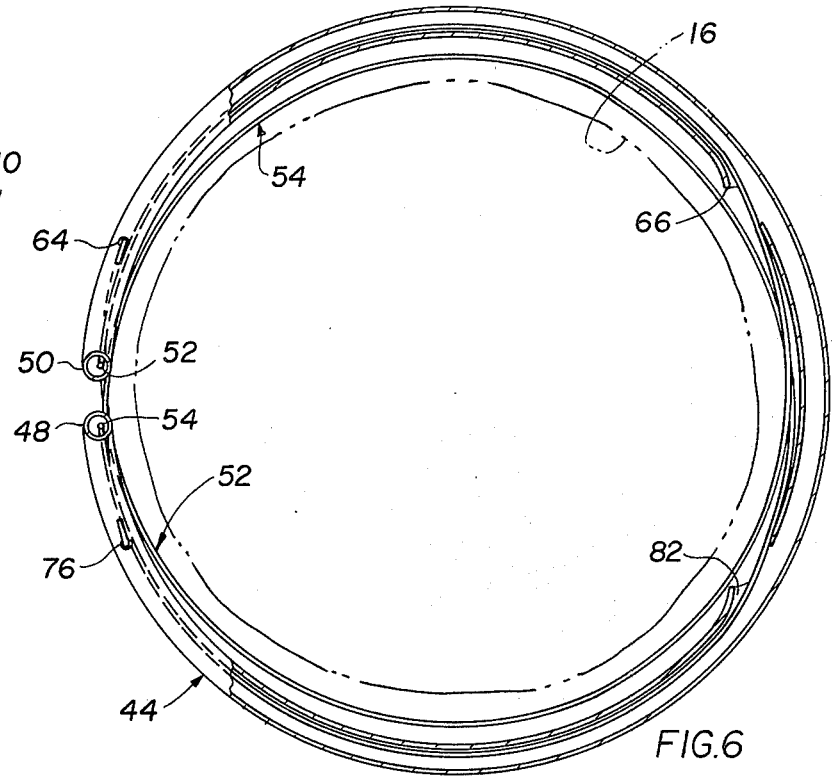
Figure 7:
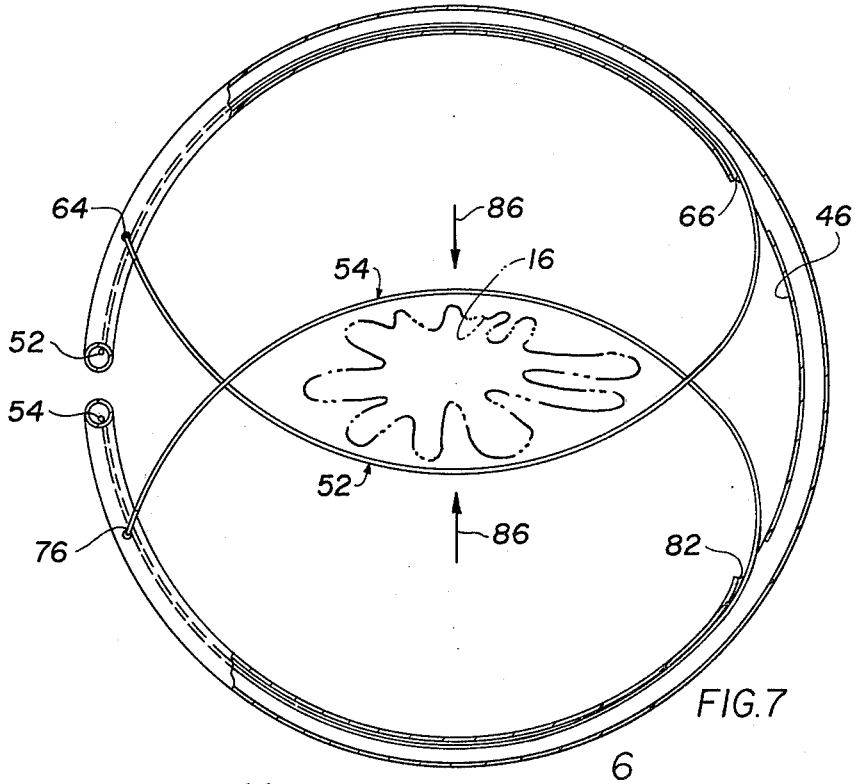

Remaining FIGS. 6 and 7 are plan views of the bag-holding member of the device hereof, taken along line 6—6 of FIG. 5; the bag of FIG. 1 being illustrated in FIG. 6 with the opening thereinto in its fully unobstructed condition, whereas in FIG. 7, said bag opening, as illustrated in phantom perspective, is in its closed condition.

To achieve obviously desirable sanitary conditions, it is advantageous to be able to readily remove the excrement of dogs or other pets from street pavements or other surfaces, and this is the primary object of the within scoop device, generally designated 10. More particularly, as is perhaps best illustrated by progressive examination of FIGS. 2A, 2B and 2C, it is contemplated, in the proper use of the device 10, to affix to it a plastic or other type of removal bag 12, in the condition illustrated in FIG. 1. That is, the opening of the bag 12 is folded to provide a cuff 14, and the bag is inverted as illustrated in FIG. 1 and in this inverted condition is mounted on a ring-like support. As a consequence, this advantageously orients the opening 16 into the bag 12 in facing relation to the pavement or other surface 18 containing the dog excrement 20 which it will be understood requires removal from the surface 18 in the interests of promoting sanitary conditions and for other such reasons. Thus, as illustrated in FIG. 2A, device 10 is positioned with the bag opening 16 over the excrement 20 and then lowered, as indicated by the reference arrow 22, in covering relation over the excrement 20, thereby achieving the condition illustrated in FIG. 2B. Next, in a manner which will be subsequently described in detail, the bag opening 16 is closed about excrement 20 forcing its transfer internally within the bag 12. When this is achieved, as illustrated in FIG. 2C, device 10 is lifted, as indicated by reference arrow 24, and the device 10 is then turned 180 degrees, thereby correspondingly inverting the bag 12 with its contents. Using cuff 14, which during removal service of the device 10 is maintained out of contact with excrement 20 and which is advantageously readily accessible, the user is able to readily remove bag 12 from the device 10 and then complete, if desired, a more permanent closing of the bag with a tie member or the like. Thereafter, the user can readily complete a sanitary disposal of the bag 12 and its contents.

From the foregoing general description, an obvious operating requirement of the device 10 is an effective means for closing the bag opening 16 following the strategic location thereof in surrounding relation about the excrement 20 as just explained in the progressive examination of FIGS. 2A–2C. In accordance with the present invention, and as illustrated in the remaining figures of the drawings to which reference is now made, device 10 includes a hollow cylindrical body 30 which serves as a handle for the device. Force fit in the lower or depending end opening 32 of the handle 30 is a plug 34 having two through bores 36 and 38 (see in particular FIG. 4). The upper end of the handle is closed by a plug 35 through which, slidably disposed internally of the handle 30, is a slide member 40 having a hand-grip 42 at its exposed upper end.

As is perhaps best illustrated in FIG. 4, connected as by force fit or other appropriate means, to the plug 34 is a tubular shaped or configurated bag-holding member 44 which, because of its shape or configuration, bounds or circumscribes the operative area 46 of a shape which, of course, conforms to that of the member 44. The significance of this will soon be apparent. The two ends of the member 44 are bent out of the plane of the area 46, as illustrated in FIG. 4, thereby providing mounting lengths or projections 48 and 50 which it will be understood are appropriately sized to provide a force fit when projected respectively through the bores 36 and 38. The force fit assembly of the tube lengths 48 and 50 within the through bores 36 and 38, and that of the plug 34 within the bottom cylindrical opening 32, is clearly illustrated in FIG. 3.

Still referring primarily to FIG. 4, the structure utilized in device 10 to actually close the bag opening 16 are preferably two lengths 52 and 54 of piano wire or other such flexible construction material, each arranged as illustrated in FIG. 4 and as now will be described in detail. Specifically, and taking the wire length 52 as an example, one end, such as 56, is provided with a hook shape and is permitted to assume a circular shape 58 which generally follows the contour of the circular tubular member 44. Each wire, as exemplified by the wire 52, is then bent, as at 60, transversely of the plane of the circle 58 so that the remaining length portion 62 thereof is advantageously oriented to be projected up through the bottom end of the hollow handle 30 for connection to the slide 40. The just described operative set-up of wire 52 (and thus also of wire 54) is achieved partially externally and partially internally of the tubular member 44. That is, the portion of the wire 52 adjacent the hook 56 is maintained outside of the tubular member 44 with only the hook 56 projected into, and thereby engaged to, the member 44 via the opening 64. As best illustrated in FIG. 6, from its connection at point 64, the length of wire 52 extends along a generally circular course which follows the generally circular shape of member 44. However, after circumscribing approximately 270 angular degrees from point 64, wire 52 is threaded through an opening 66 in the member 44 and thus proceeds internally thereof for the remainder of the circular shape of member 44, as well as being internally threaded through the straight length portion 50 thereof. Again, as is perhaps best illustrated in FIG. 4, it is contemplated that the terminal portion of the straight length portion 62 of wire 52 will project through the upper end of tube 50 and that this projecting end will be bent to provide a hook or connecting portion 68 which is inserted through a horizontally oriented bore 70 at the lower end of slide 40. Similarly projected through the opening 70, but from the oposite side, is bent portion 72 of the wire length 54 which is arranged in a similar, but opposing, fashion in relation to the member 44. Once the length portions 68 and 72 are projected within the opening 70, a locking member 74 is urged down along the slide 40 into locking position over the wires 52 and 54, thus completing the attachment or connection of these wires to the end of the slide 40, all as is clearly illustrated in FIG. 3.

Although it should be readily apparent how the wire 54 is arranged similar to the wire 52 on the member 44, but in opposing relation thereto, for completeness sake a description thereof will now be provided. Specifically, wire 54 is provided with a hook 76 at one end which when projected in the opening 78 of member 44 anchors this end of the wire in place. From connection point 76 the wire circumscribes a circle 80, in which the orientation thereof is clockwise, whereas circle 58 of wire 52 is counterclockwise. Also, at approximately a 270 degree traverse, the circular shape 80 is threaded through an opening 82 internally of the tube 44 and then up through the bottom end of the handle 30 for its connection, as at 72, to slide 40.

Reference should now be made to FIGS. 6 and 7 which best illustrate how the wires 52 and 54 produce closure of the bag opening 16. In FIG. 6 reference line 16 will be understood to represent the bag opening as the same exists when in surrounding relation to the excrement to be removed which is located centrally of the opening 16. It will next be assumed, as illustrated in FIG. 7, that slide 40 is raised through a wire-pulling stroke 84, all as is illustrated for example in FIG. 2B. This results in the wire lengths 52 and 54 being drawn up within the hollow handle 30 and thus a consequent reduction in the length of the wire which remains externally of the member 44, namely from connection points 64, 76 to the respective openings 66, 82. Stated another way, the drawing up of the wires 52 and 54 within the handle 30 results in flexuring of the wires 52 and 54 from their original circular shapes into shapes of more severe curvature, all as is illustrated in FIG. 7. The practical effect of the foregoing is that the wire lengths adjacent the connected ends 64 and 76 of the wires 52 and 54 thus move through closing movement 86 across the area 46, and since the bag opening 16 is in an interposed position between these wire lengths moving in these opposing directions, the bag opening 16 is effectively closed, as illustrated in phantom perspective in FIG. 7.

Actually, since the device 10 holds the cuff 14 against the surface 18 the portion of the bag which bounds the opening 16, as represented in FIG. 6, remains supported along the underside of the member 44. However, as a result of closing movement 86 of the wires 52 and 54 across the opening 46, the adjacent portion of the bag 12 forms itself into the restricted opening 16 represented in FIG. 7. Following achievement of the closed bag condition 16 of FIG. 7, the removal procedure already described in connection with FIGS. 2A, 2B and 2C is utilized to in turn achieve sanitary disposal of bag 12 and its contents.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

A stop 88 in the form of an indent defined in the wall of the body 30 effects a protrusion within the same. This protrusion serves as a limiting stop against which the member 74 abuts in its upward stroke 84 to thereby limit the length of the stroke and, as a consequence, the extent to which the wires 52 and 54 close relative to each other.

What is claimed is:

1. A device for removing dog excrement or the like from a surface comprising a bag for receiving said excrement preparatory to the removal thereof, a bag-holding member of a selected shape bounding an opening about which said bag is supported in inverted relation with an opening communicating into said bag being formed by said shape, a handle and means for connecting said bag-holding member and inverted bag in depending relation from said handle so as to facilitate the placement of said bag opening in surrounding relation to said excrement, and normally spread apart oppositely disposed double ended encircling closure means on said bag-supporting member mounted for closing movement into said opening of said member, whereby said bag opening is adapted to be closed about said excrement and thereafter inverting said bag provides a disposal enclosure for same.

2. An excrement removal device as defined in claim 1 wherein said closure means are wires of an appropriate flexibility so that the flexuring thereof provides said closing movement to said closure means.

3. An excrement removal device as defined in claim 2 wherein said shaped bag-holding member is a circular tube, and said wires are in part threaded through said tube for attachment to said handle, whereby actuation of said handle through a wire-pulling stroke causes said flexuring of said wires and said closing movement thereof.

4. An excrement removal device as defined in claim 3 wherein said shaped bag-holding member is connected to extend from said handle to be substantially parallel to the surface and said bag is cuffed about said member during use of said removal device, whereby said cuff is adapted to be pressed against the surface when said bag opening is placed in surrounding relation to the excrement and thereby held against movement during said closing movement of said closure means so that said cuff is available for subsequent sanitary removal of said bag from said device.

5. A device for removing dog excrement or the like from a surface comprising an elongated handle, a member circumscribing an opening connected transversely of the depending end of said handle, an excrement removal bag having an operative open position cuffed in an inverted relation about said member so that the interior of said open bag is in communication with and forms an extension of said opening of said circumscribing member, and wire closure means operatively arranged on said circumscribing member for movement from clearance positions in opposing directions across said opening, whereby said bag opening is effectively closed by said wire closure means following the placement thereof in covering relation over said excrement.

6. An excrement removal device as defined in claim 5 including a slide within said handle operatively connected with said wire closure means whereby said slide is movable through a wire-pulling stroke incident to producing said bag-closing opposing movement in said wire closure means.

7. An excrement removal device as defined in claim 6 wherein said member circumscribing said opening is a substantially circular tube, and said wire closure means are wires that are in part threaded through said tube for attachment to said slide.

8. An excrement removal device as defined in claim 7 wherein the construction material of said circumscribing member is rigid such that said bag cuff is adapted to be pressed against the surface when said bag opening is placed in surrounding relation to the excrement and thereby held against movement during the closing movement of said wire closure means so that said cuff is available for subsequent sanitary removal of said bag from said device.

9. In a device for enabling the separation and removal of excrement and the like from a surface, a member for positioning against the surface in encirclement about the excrement, a pair of oppositely disposed double ended wire-like elements mounted at one of each of their ends to said member and retained by said member in initial encircling relationship about the excrement, a handle connected with said member, and a slide in said handle for movement relative thereto and connected with the other ends of each of said wire-like elements to move said elements relative to each other in scissoring motion and to said member to close their encircling relationship and to move beneath the excrement to separate the same from the surface.

10. In a device as in claim 9, and a bag mounted about said member and between said encircling wire-like elements for retentions thereby in open encirclement about the excrement, said bag being closed about the excrement in response to the scissoring movement of said elements to close beneath the excrement and to contain the same therewithin to enable the removal of the excrement from the surface.

* * * * *